US007171930B2

(12) United States Patent
Keel

(10) Patent No.: US 7,171,930 B2
(45) Date of Patent: Feb. 6, 2007

(54) ROCKER ARM FOR VALVE ACTUATION IN INTERNAL COMBUSTION ENGINES

(76) Inventor: Alberto Keel, Laufenbrunnenstrasse 38, Grabs (CH) CH-9472

( * ) Notice: Subject to any disclaimer, the term of this patent is extended or adjusted under 35 U.S.C. 154(b) by 0 days.

(21) Appl. No.: 11/061,462

(22) Filed: Feb. 22, 2005

(65) Prior Publication Data

US 2005/0166876 A1 Aug. 4, 2005

Related U.S. Application Data

(63) Continuation of application No. PCT/CH03/00307, filed on May 14, 2003.

(30) Foreign Application Priority Data

Aug. 20, 2002 (CH) ..... 1456/02

(51) Int. Cl.
*F01L 1/34* (2006.01)

(52) U.S. Cl. ..... 123/90.15; 123/90.2; 123/90.16; 123/90.41; 123/90.44; 74/559; 74/569

(58) Field of Classification Search ..... 123/90.2, 123/90.15
See application file for complete search history.

(56) References Cited

U.S. PATENT DOCUMENTS

| | | | | |
|---|---|---|---|---|
| 1,469,155 A | | 9/1923 | Hedberg | |
| 3,367,312 A | * | 2/1968 | Einar | 123/321 |
| 4,438,736 A | | 3/1984 | Hara et al. | |
| 4,475,496 A | * | 10/1984 | Sugahara | 123/198 F |
| 4,648,362 A | * | 3/1987 | Kastlunger | 123/182.1 |
| 4,903,651 A | * | 2/1990 | Matsuura et al. | 123/90.46 |
| 5,003,939 A | | 4/1991 | King | |
| 5,025,761 A | * | 6/1991 | Chen | 123/90.16 |
| 5,857,438 A | | 1/1999 | Barnard | |
| 5,937,809 A | | 8/1999 | Pierik et al. | |
| 6,053,134 A | * | 4/2000 | Linebarger | 123/90.16 |
| 6,415,754 B1 | | 7/2002 | Michio et al. | |

FOREIGN PATENT DOCUMENTS

| | | |
|---|---|---|
| DE | 348 023 | 2/1922 |
| DE | 20 24 972 | 12/1971 |
| DE | 34 43 855 A1 | 4/1985 |
| DE | 196 43 711 | 4/1998 |
| DE | 198 30 168 | 1/2000 |
| JP | 55 148910 | 11/1980 |

* cited by examiner

*Primary Examiner*—Thomas Denion
*Assistant Examiner*—Kyle M. Riddle
(74) *Attorney, Agent, or Firm*—Buchanan Ingersoll and Rooney

(57) ABSTRACT

A rocker arm is disclosed for valve actuation in an internal combustion engine. The rocker arm includes at least two rotational axes which can be selected as desired to modify a relation between a force arm and a load arm. Control times and valve lift can thus be influenced in a targeted manner.

8 Claims, 8 Drawing Sheets

ROCKER ARM FOR VALVE ACTUATION IN INTERNAL COMBUSTION ENGINES

CROSS REFERENCE TO RELATED APPLICATIONS

This application claims priorities under 35 U.S.C. §119 to Swiss Application No. 1456/02 filed Aug. 20, 2002, and as a Continuation application Under 35 U.S.C. §120 to PCT Application No. PCT/CH2003/000307 filed as an International Application on 14 May 2003 designating the U.S., the entire contents of which are hereby incorporated by reference in their entireties.

BACKGROUND

1. Field

A rocker arm is disclosed for valve actuation in internal combustion engines. A rocker arm is disclosed with a reversible step-up ratio. By its use, the valve lift and the control time in internal combustion engines with suspended valves can be varied.

2. Background

The aforementioned system has the fundamental concept of making it possible to regulate the lift and the control times of the valves in an internal combustion engine. Engines with variable valve drive have major advantages over "normal" engines. They have excellent running properties over the entire rpm range. Both pollutant emissions and fuel consumption can be reduced considerably. Because the lift and the valve control times are designed to be regulatable, higher outputs can be attained even with smaller engines. The entire automotive industry is devoting major effort to this much-needed technology.

In the prior art, German Patent Disclosure DE-A 34 43 855 discloses a rocker arm system which varies the step-up ratio with the aid of a rack and a toothed quadrant. U.S. Pat. No. 4,438,736 discloses a system that includes a cam disk between the rocker arm and the valve. U.S. Pat. No. 5,937,809 discloses a system in which the control times are variable by the rotation of the rocker arm about the camshaft. U.S. Pat. No. 5,003,939 shows a system in which the camshaft rotates in an eccentric element. The valve lift is variable by rotation of the eccentric element. U.S. Pat. No. 5,857,438 shows a hydraulic valve lift regulation.

SUMMARY

A rocker arm is disclosed which can be configured in exemplary embodiments to be very compact and simple in construction. This is attained by providing that for the valve actuation of internal combustion engines, the rocker arm has more than one (e.g., two) rotational axes, which can be selected as needed. The entire mechanism for attaining the variable control time can be integrated with the rocker arm. Because there are many possible variant embodiments, it is even possible for engines of an older and even very old design to be equipped with the provisions described herein (FIG. 13). New engines can be constructed in simplified fashion. Technically complex valve drives of the kind known from the prior art described above can be dispensed with.

BRIEF DESCRIPTION OF THE DRAWINGS

The invention is described below in terms of an exemplary embodiment in conjunction with schematic drawings.

The variant described is based for instance on a traditional American V-8 engine with a central camshaft that dates from 1965. The drawings, which are not to scale, show the following.

DETAILED DESCRIPTION

Figure 1:
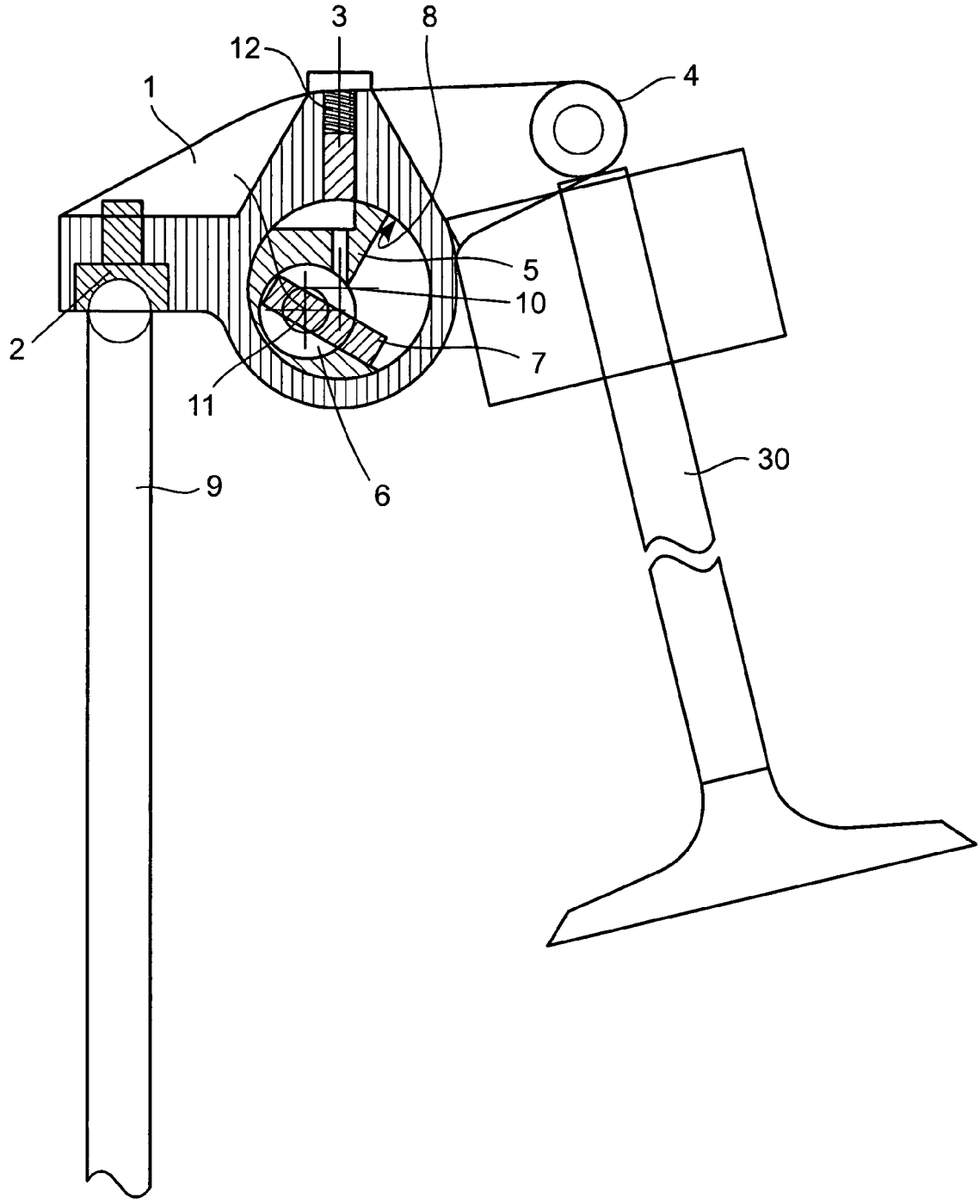
FIG. 1 shows a rocker arm according to an exemplary embodiment of the invention, in cooperation with a valve.

The exemplary embodiment shown in FIG. 1 of a rocker arm includes a rocker arm body 1. In the exemplary embodiment shown, the rocker arm body 1 is driven by a push rod 9. In an alternative variant embodiment, it may also be driven directly by the camshaft. A ball socket 2 serves to receive the push rod 9. The ball socket 2 is seated with a press fit in the rocker arm body 1. It can also be screwed in. An actuation head 4 is disposed on the opposite end of the rocker arm body 1, and a valve 30 can be actuated by it. The rocker arm is embodied such that in a first position, it can rotate freely about an eccentric bush 5. The eccentric bush 5 is inserted into a central bore 8 of the rocker arm body and is capable of rotating freely about a central shaft 6 of the rocker arm by a defined angle. Upon an exertion of force, the eccentric bush 5 has the tendency to rotate counterclockwise. A stop pin 7 provided as a means of preventing relative rotation prevents that. As a result, the rocker arm rotates about a first rotational axis 10. A slaving pin 3, loaded by a compression spring 12, is kept in the enabling position by means of oil pressure. If the oil pressure is reduced to a minimum, then the slaving pin connects the rocker arm body 1 to the eccentric bush 5. The rocker arm body 1 then rotates together with the eccentric bush 5 about the rotational axis 11 of the central shaft 6.

Figure 2:
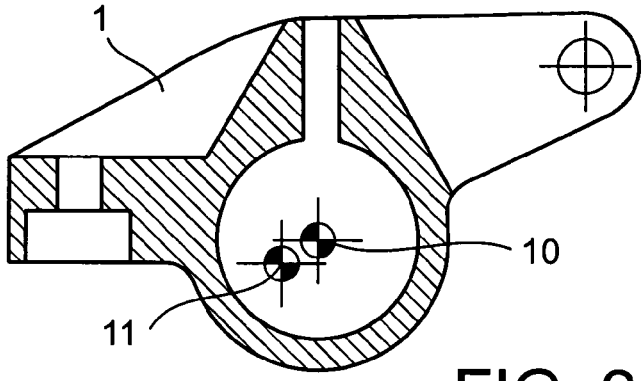
FIG. 2–FIG. 4 show details of the rocker arm of FIG. 1, each with pivot points and lever arms explained on the rocker arm body.
Figure 3:
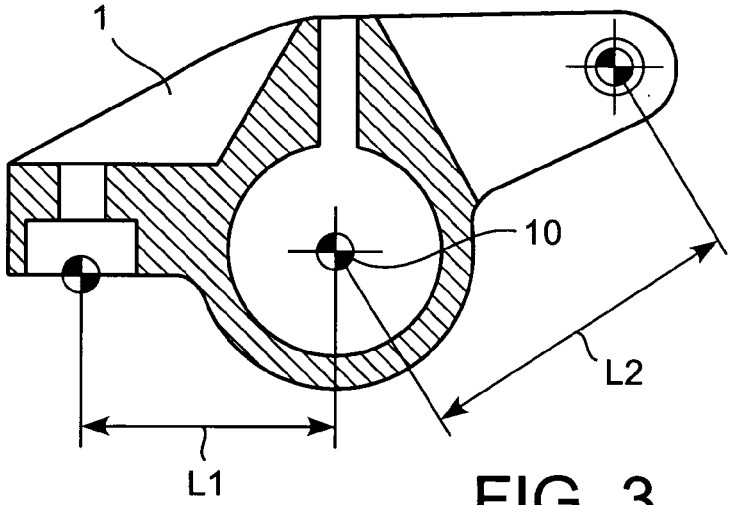

In FIG. 2, the two different rotational axes 10 and 11 of the rocker arm are each marked by crosshairs on the rocker arm body 1. Depending on the pivot point about which the rocker arm is rotating, the step-up ratio of the force arm L1 and load arm L2 varies, as can be seen from FIG. 3 and FIG. 4.

Figure 5:
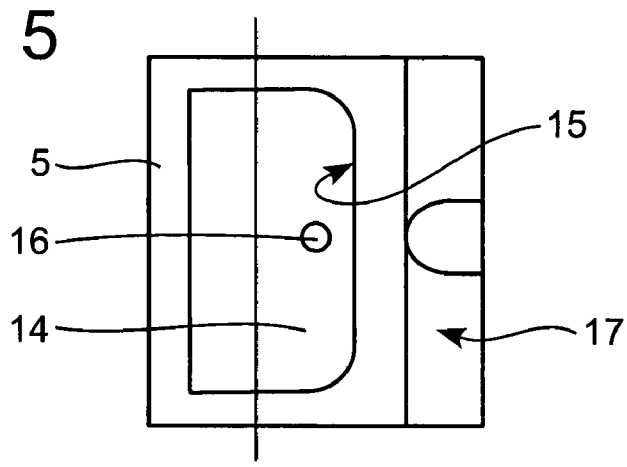
FIG. 5–FIG. 7 show details of the rocker arm, in particular of an eccentric bush and main shaft with a stop pin.
Figure 6:
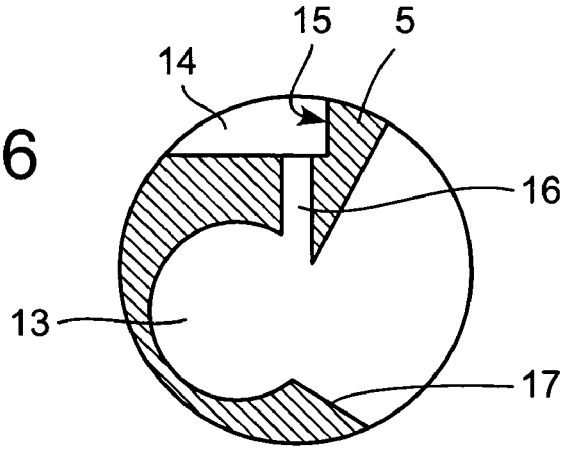
Figure 7:
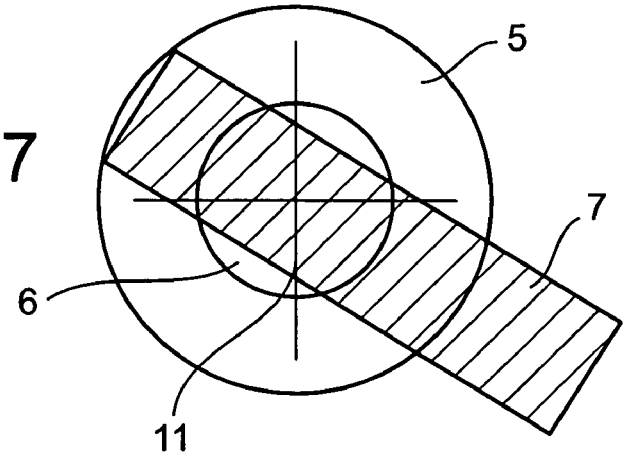
Figure 8:
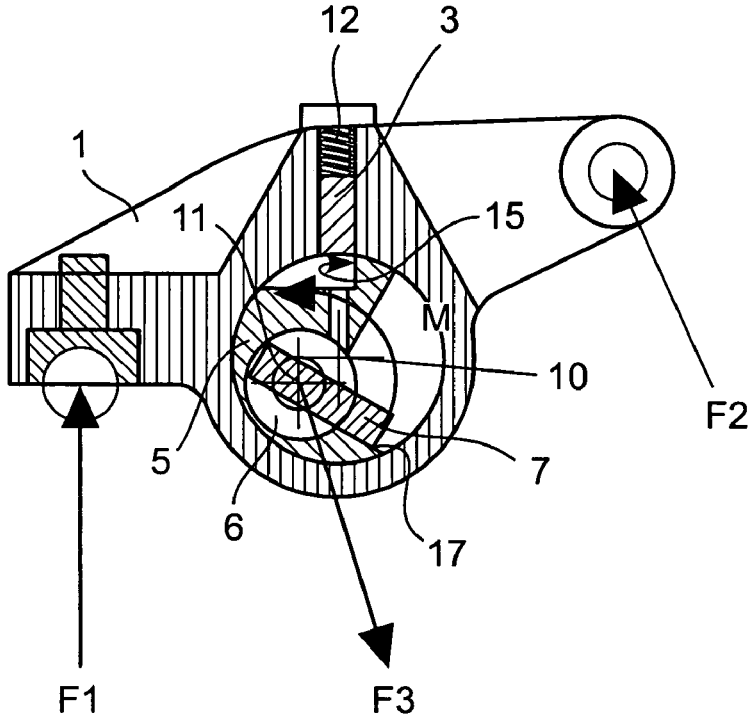
FIG. 8 and FIG. 9 show two views of the entire rocker arm.

FIGS. 5 and 7 show a top view and a sectional view of the eccentric bush 5, which in the assembled state of the rocker arm is received by the central bore of the rocker arm body. The eccentric bush 5 is an element used for attaining the different step-up ratios. It is provided with an axial bore 13 and has a milled recess 14 on its surface, with a slaving face 15. An oil bore 16 extends from the milled recess 14 in the direction of the axial bore 13. A stop face 17 serves to brace the stop pin. As can be seen from FIG. 1 and FIG. 7, the eccentric bush 5 is slipped on the central shaft 6 with the rotational axis 11 and is secured by the stop pin 7. The stop pin 7 and the stop face 18 are in contact with one another and prevent rotation of the eccentric bush 5 about the rotational axis 11 of the central shaft 6. This tendency of the eccentric bush 5 to rotate is caused by the torque M which arises upon the exertion of force when the valve opens. As a result, it is assured that the rotational axis of the rocker arm continues to be the rotational axis 10. This is shown in FIG. 8. In particular, FIG. 8 also shows the forces F1–F3 that occur upon opening of the valve and that result in the torque M, which attempts to rotate the eccentric bush 5. As long as the spring-loaded slaving pin 3 does not enter into engagement with the slaving face 15, the rocker arm can rotate freely about the eccentric bush 5 with the first rotational axis 10. The eccentric bush 5 cannot rotate relative to the central shaft 6, since it is blocked by the stop pin 7. In this state, the rocker arm operates with a low step-up ratio, in accordance with FIG. 3.

Figure 4:
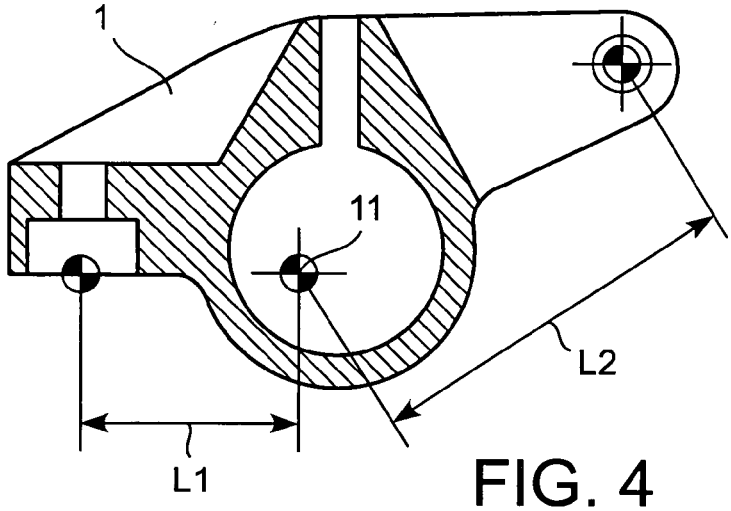
Figure 9:
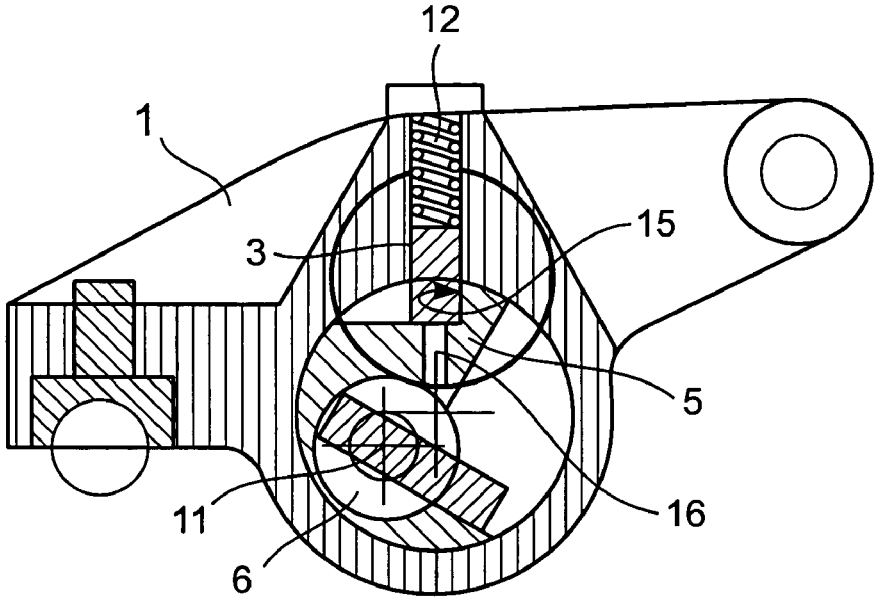

FIG. 9 shows the status of the rocker arm in which a switchover is made from a low to a high step-up ratio; the rocker arm accordingly rotates as in FIG. 4 about the rotational axis 11 of the central shaft. A circle drawn around it in FIG. 9 highlights the slaving pin 3 that is responsible for the switchover operation. This slaving pin is acted upon by oil pressure via the oil bore 16 when the engine is running in the low rpm range. The oil pressure acts counter to the spring force of the compression spring 12 and keeps the slaving pin 3 out of engagement with the slaving face 15 of the eccentric bush 5. The oil pressure originates for instance in the oil circulation system of the engine and is fed into the central shaft 6, which is embodied as a hollow shaft. The oil reaches the switchover mechanism in the rocker arms through continuous bores in the central shaft.

If the load state of the engine changes such that a switchover to longer control times and a longer valve lift is expedient, this is done by the engine management system. To that end, an electrically actuatable hydraulic valve can be activated in an exemplary embodiment, which reduces the oil pressure in the rocker arm system to a minimum, but an adequately large amount of lubrication is still assured. With the disappearance of the contrary force of the oil pressure, the compression spring 12 can now press the slaving pin 3 in the direction of the eccentric bush 5. As soon as the valve has closed, the milled recess in the eccentric bush 5 is uncovered, and the slaving pin 3 drops into the bush and enters into engagement with the slaving face 15. As a result, the eccentric bush 5 is mechanically connected to the rocker arm body 1. This switchover operation takes place within fractions of a second while the engine is running. Now, the rocker arm body 1 rotates together with the eccentric bush 5 about the rotational axis 11 of the central shaft 6. As a result, the rocker arm has a high step-up ratio for the valve actuation, as shown in FIG. 4.

Figure 10:
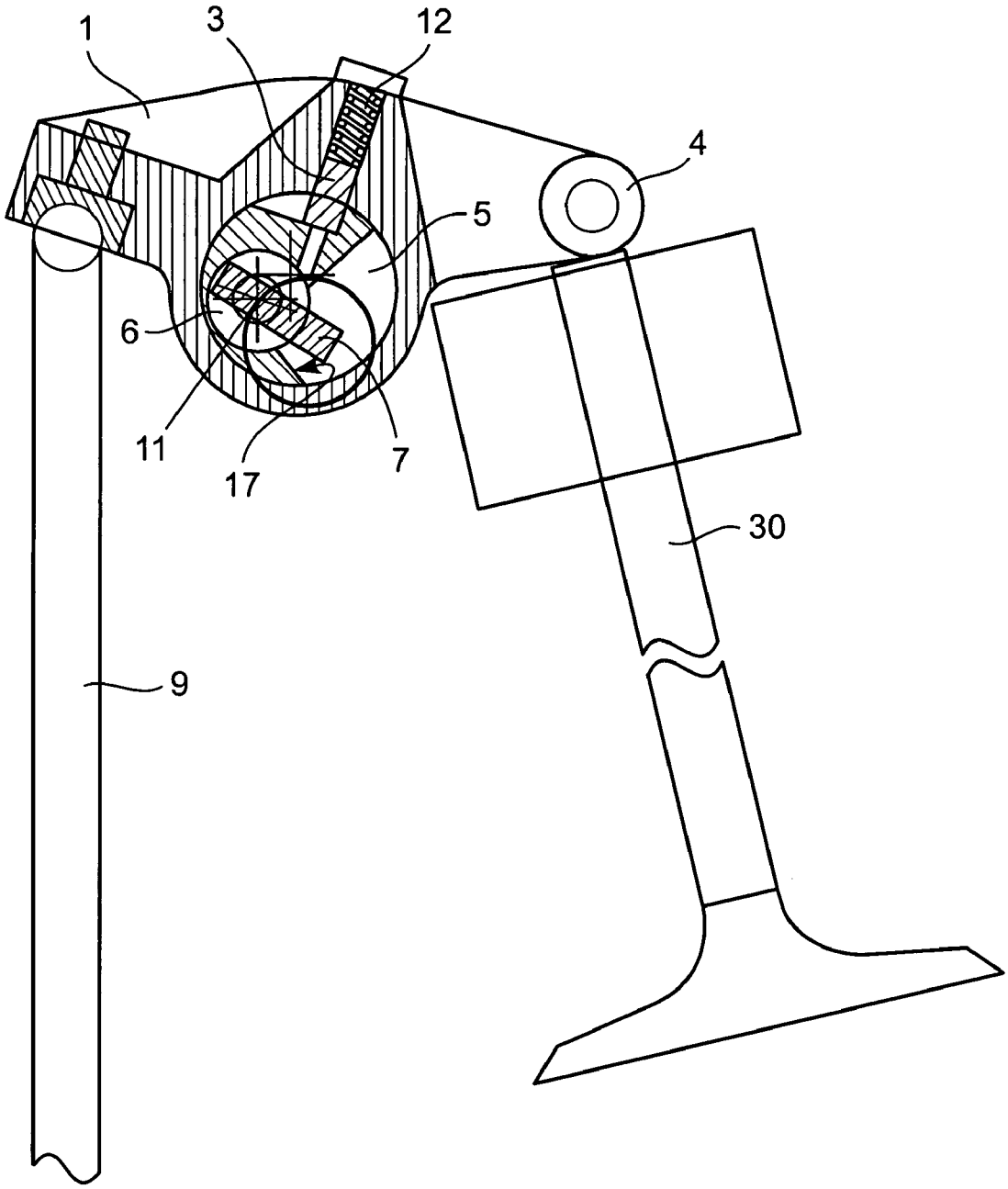
FIG. 10 shows a view analogous to FIG. 1, which shows an exemplary rocker arm in the loaded state with a high step-up ratio.

FIG. 10 shows the rocker arm with the valve open. The reference numerals match those of FIG. 1. The circle highlights the fact that the eccentric bush 5 can rotate out of the stop between the stop pin 7 and the stop face 17. The eccentricity of the eccentric bush 5 determines the valve lift difference and the difference in the nominal control times. The longer lift that results from the change in the rotational axis can be seen directly by a comparison of FIGS. 1 and 10.

Figure 11A:
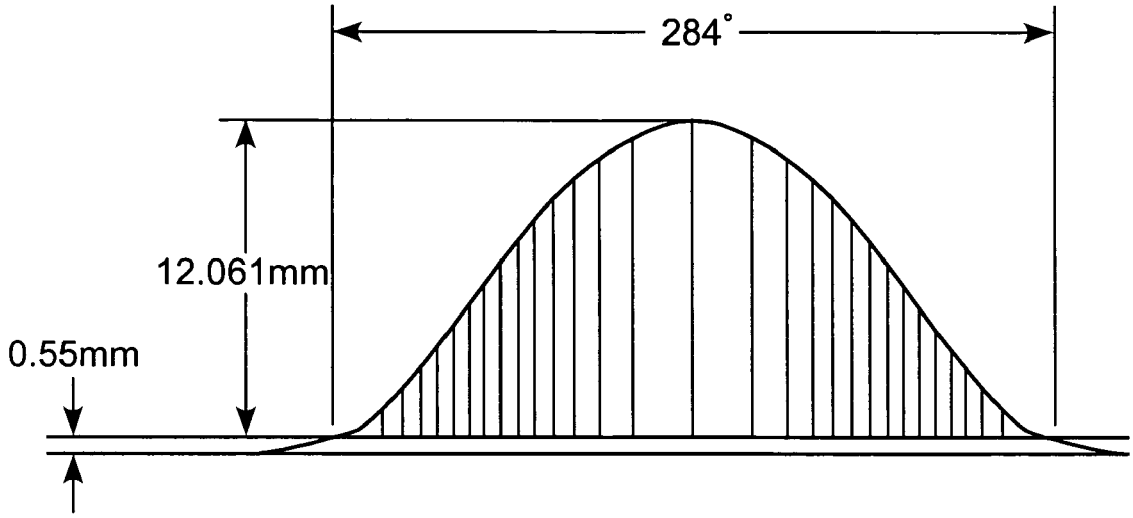
FIG. 11*a* and FIG. 11*b* show two graphs showing valve lift and control times at different rocker arm step-up ratios.
Figure 11B:
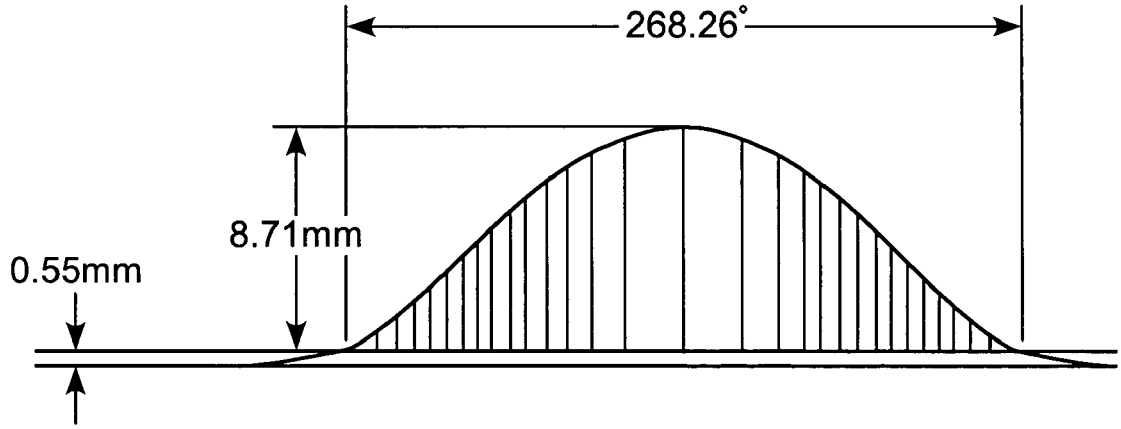
Figure 12:
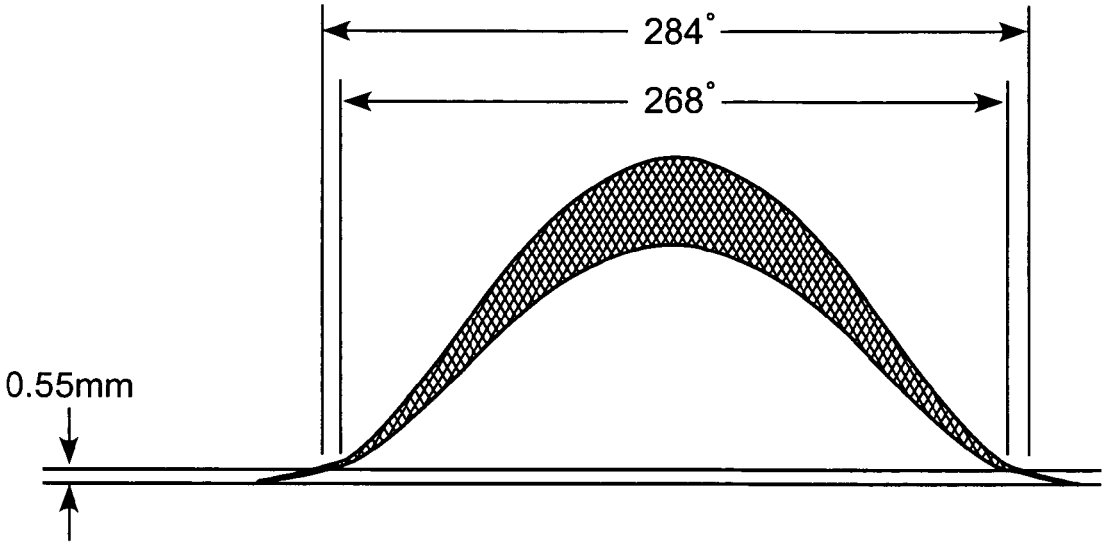
FIG. 12 shows a differential view made by superimposing the two graphs of FIG. 11*a* and FIG. 11*b;*

In the graphs in FIG. 11*a*, FIG. 11*b* and FIG. 12, the influence on the control time and on the valve lift of the switchover can be seen. The camshaft used in this example is distinguished by high power in the high rpm range. In the low rpm range, without a switchover to short control times, it would not produce satisfactory results. The graph in FIG. 11*a* for instance shows a valve lifting curve at a rocker arm step-up ratio of 1.5:1, which represents the normal situation. The valve play setting is 0.55 mm. The effective control time is 284°. The effective valve lift is 12.06 mm long. The graph in FIG. 11*b* shows the course of the valve lift at a rocker arm step-up ratio of 1.1:1. The valve play setting is again 0.55 mm. The effective control time is now 268°, and the effective valve lift attains 8.71 mm in length. In FIG. 12, the two graphs of FIG. 11*a* and FIG. 11*b* are combined, in order to make the differences in the effective control times and the effective valve lift visible.

Figure 13:
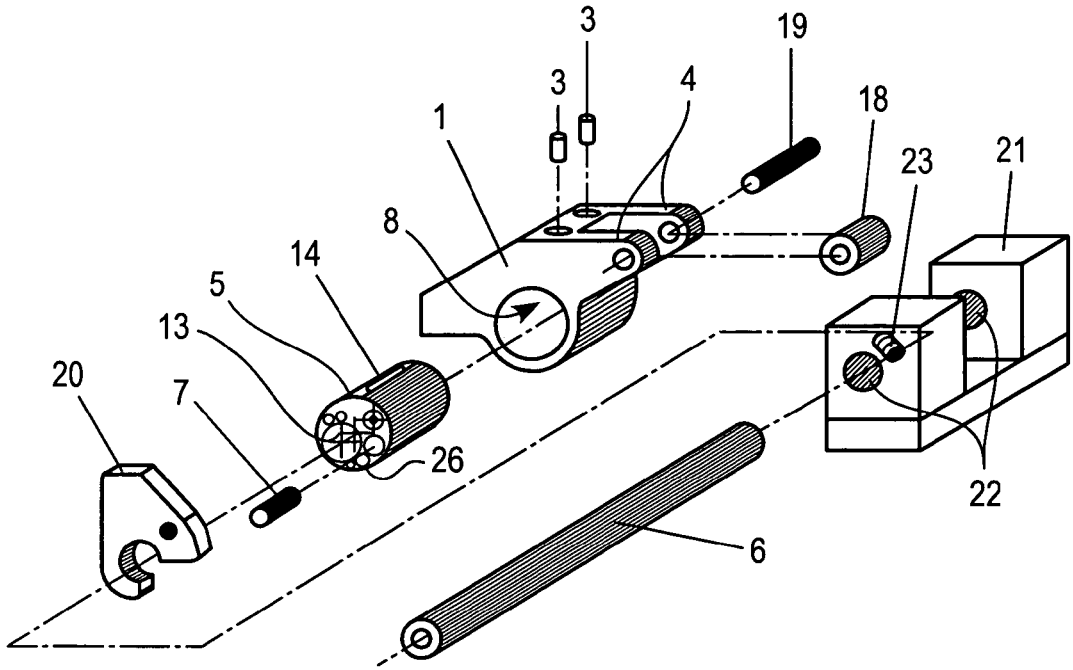
FIG. 13 shows an exploded view of a variant embodiment of a rocker arm as disclosed herein.

FIG. 13 shows a further exemplary embodiment of the rocker arm in an exploded view. Identical elements are identified by the same reference numerals. Once again, the rocker arm body is identified by reference numeral 1. The rocker arm body 1 is provided with a central bore 8, which receives the eccentric bush 5. The milled recess on the circumferential face of the eccentric bush 5 is identified by reference numeral 14 and serves to receive two slaving pins 3, which are guided in bores in the rocker arm body 1. The compression springs, which are again seated in the bores and load the slaving pins 3, are not shown in FIG. 13. The actuation head 4 of the rocker arm body 1 is embodied in forked form and between the tines of the fork has an actuation roller 18, which is fixed via an axle pin 19. A bore 26 receives the stop pin 7. The axial bore 13 in the eccentric bush 5 receives the central shaft 6. It can be seen from this drawing that the central shaft 6 is embodied as a hollow shaft, for delivering oil. An adjusting body 20 for the basic setting of the rocker arm is also seated on the central shaft 6. This adjusting body can be connected to the eccentric bush 5. The entire rocker arm is mounted via the central shaft 6 on a rocker-arm holder 21 with leadthroughs 22 for the central shaft 6. A milled recess 23, which assures the adjustability of the adjusting body 6 is provided on the rocker-arm holder 21.

Figure 14:
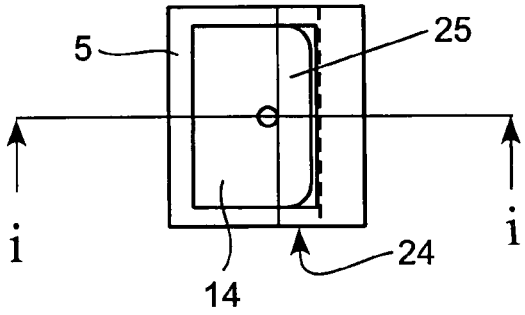
FIG. 14–FIG. 16 show a modified eccentric bush in three elevation views.
Figure 15:
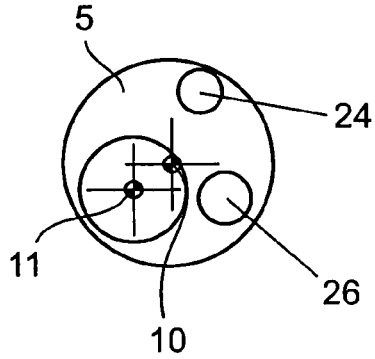

The eccentric bush shown in FIG. 14–FIG. 16 is again identified by reference numeral 5. The milled recess on the circumferential face of the eccentric bush 5 is identified by reference numeral 14. In the region of the slaving face of the eccentric bush 5, an axial receiving bore 24 is provided for a roller pin 25. The roller pin 25 can be of a hardened steel and can be freely rotatable in a loose fit in the receiving bore 24. The two rotational axes of the rocker arm body are indicated by reference numerals 10 and 11 in the side view in FIG. 15 and the sectional view in FIG. 16. The bore in the eccentric bush 5 into which the stop pin 7 (FIG. 13) is press-fitted is again identified by reference numeral 26.

Figure 16:
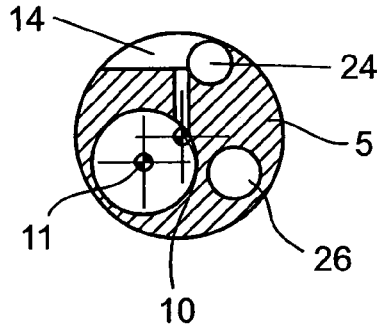
Figure 17:
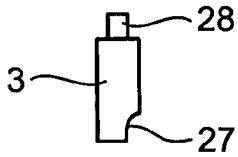
FIG. 17 and FIG. 18 show two elevation views of a variant embodiment of a slaving pin for use in conjunction with the eccentric bush of FIG. 14–FIG. 16.
Figure 18:
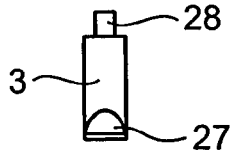

FIGS. 17 and 18 show a variant of the slaving pin, which belongs to the eccentric bush of FIG. 14–FIG. 16 and which is again identified overall by reference numeral 3. The slaving pin 3 has a polished face 27. In the switchover operation, the polished face 27 rolls over the roller pin 25 in the eccentric bush 5 (FIGS. 14–16). The curvature of the polished face 27 is embodied such that the contact between the slaving pin 3 and the roller pin 25 is always a linear contact. This reduces the pressure per unit of surface area. The embodiment of the slaving pin and the modified eccentric bush with the roller pin also prevent tilting of the slaving pin. This can improve the switchover properties. The embodiment details of the rocker arm components in FIG. 14–FIG. 18 also make it possible for the eccentric bush 5 itself to be made from an unhardened steel. It is sufficient to harden the components that come into contact with one another, that is, the roller pin 25 and the slaving pin 3. The modified slaving pin 3 also has a turned peg 28, which serves to receive the compression spring that is thrust with slight pressure against the turned peg 28. The compression spring is fixed via a spring cap. The slaving pin 3 is thus secured against relative rotation via the compression spring that is seated with a press fit on the turned peg 28.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A rocker arm for valve actuation in an internal combustion engine, comprising:

two lever arms, namely a force arm (L1) and a load arm (L2); and at least two rotational axes about which the rocker arm is configured to rotate, the rotational axes being selectable;

wherein the rotational axes are provided on a central shaft and within one or more eccentric elements, which are pivotally supported on said central shaft, which central shaft maintains its position unchanged in a switchover operation of the rotational axes and during operation of said rocker arm; and wherein the one or more eccentric elements are each equipped with an adjustable stop, said adjustable stop comprising an element nonrotatably arranged on said central shaft, which limits an angle of rotation of said one or more eccentric elements about the central shaft.

2. The rocker arm according to claim 1, comprising:

two rotational axes.

3. The rocker arm according to claim 1, wherein the one or more eccentric elements are disposed in a central bore of a rocker arm body.

4. The rocker arm according to claim 1, wherein the rotational axes can be selected by means of a switching mechanism.

5. The rocker arm according to claim 4, wherein the switching mechanism includes a hydromechanical actuation system.

6. The rocker arm according to claim 5, wherein the hydromechanical actuation system communicates with an oil circulation system of the engine.

7. The rocker arm according to claim 1, wherein the rocker arm maintains a stationary position relative to the engine during a switchover operation of the rotational axes.

8. The rocker arm according to claim 1, wherein the force arm and the load arm extend in opposite directions of the rocker arm from the two rotational axes.

* * * * *